US006170422B1

(12) United States Patent
Macander et al.

(10) Patent No.: US 6,170,422 B1
(45) Date of Patent: Jan. 9, 2001

(54) ATTACHMENT OF EQUIPMENT TO COMPOSITE SANDWICH CORE STRUCTURES

(75) Inventors: Aleksander B. Macander, Rockville, MD (US); Erik A. Rasmussen; Milton O. Critchfield, both of Great Falls, VA (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/461,228

(22) Filed: Dec. 16, 1999

(51) Int. Cl.[7] ..... B63B 11/00
(52) U.S. Cl. ..... 114/116; 114/78
(58) Field of Search ..... 114/65 R, 78, 114/88, 116

(56) References Cited

U.S. PATENT DOCUMENTS

| | | | | |
|---|---|---|---|---|
| 3,812,808 | * | 5/1974 | Shirota et al. | 114/78 |
| 4,038,799 | * | 8/1977 | Shanks | 114/78 |
| 4,238,913 | * | 12/1980 | Holmes | 114/116 |
| 4,261,146 | * | 4/1981 | Holmes | 114/116 |
| 4,508,047 | * | 4/1985 | Bordat | 114/78 |

* cited by examiner

*Primary Examiner*—Stephen Avila
(74) *Attorney, Agent, or Firm*—Jack Forrest; Jacob Shuster

(57) ABSTRACT

Equipment is removably connected by a load transfer element and a removable fastener bolt to a core sandwich type of bulkhead through a plug-in insert, adhesively bonded to the bulkhead at interface surfaces within a pocket formed in the bulkhead for reception of such insert.

7 Claims, 2 Drawing Sheets

ATTACHMENT OF EQUIPMENT TO COMPOSITE SANDWICH CORE STRUCTURES

The present invention relates generally to the attachment of equipment to bulkhead type of support structures.

BACKGROUND OF THE INVENTION

The attachment of equipment and distributed systems to stiffened steel bulkheads or overheads is straightforward and has been extensively used on board Naval vessels. The typical method is to weld a steel bracket or channel directly to a steel bulkhead or transverse frame to which the specific equipment is then directly attached by means of any suitable mechanical fastening arrangement. Welding attachment methods heretofore developed and utilized are not found to be suitable, reliable or desirable for survival of the shock and seaway loading of the attached equipment on composite sandwich core types of bulkheads. It is therefore an important object of the present invention to provide for simple, affordable and more reliable attachment of equipment to composite sandwich construction types of support structure, such as that currently associated with marine vessel bulkheads.

SUMMARY OF THE INVENTION

In accordance with the present invention, attachment of equipment to one of the rigid face skins of a bulkhead having a less rigid core sandwiched between such face skins, is initiated by formation of a pocket within the bulkhead at a selected location, into which a rigid insert is adhesively anchored. The insert which projects from such pocket is releasably attached by a toggle bolt fastener to a load transfer element located externally of the bulkhead in close spaced relation to the rigid face skin through which the insert projects into the pocket. Such load transfer element is attached by any suitable means to the equipment in spaced relation to the pocket location at which a relatively large load transfer interface surface is formed in the bulkhead by the pocket for adhesive bonding thereof to the insert.

BRIEF DESCRIPTION OF DRAWING

A more complete appreciation of the invention and many of its attendant advantages will be readily appreciated as the same becomes better understood by reference to the following detailed description when considered in connection with the accompanying drawing herein.

DETAILED DESCRIPTION OF PREFERRED EMBODIMENTS

Figure 1:
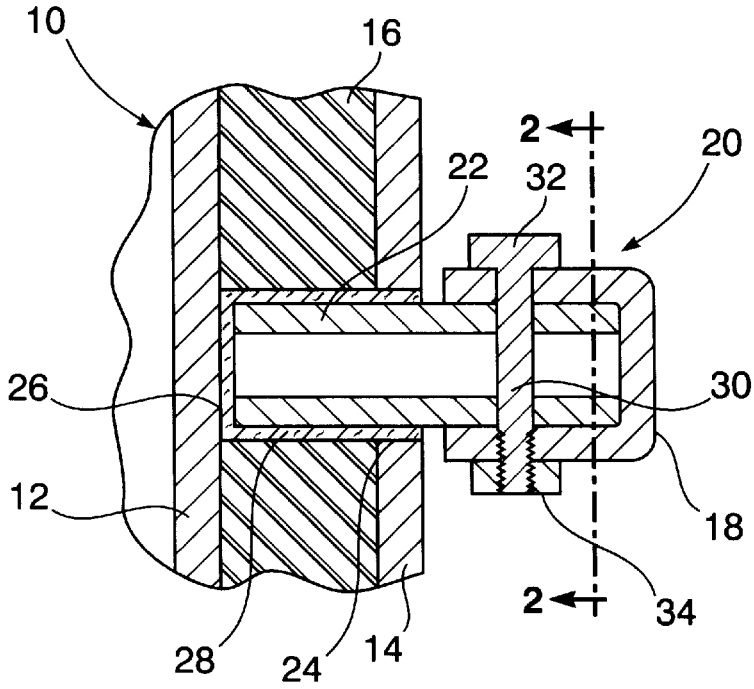
FIG. 1 is a partial side section view of an attachment at one location on a bulkhead, in accordance with one embodiment of the present invention.
Figure 2:
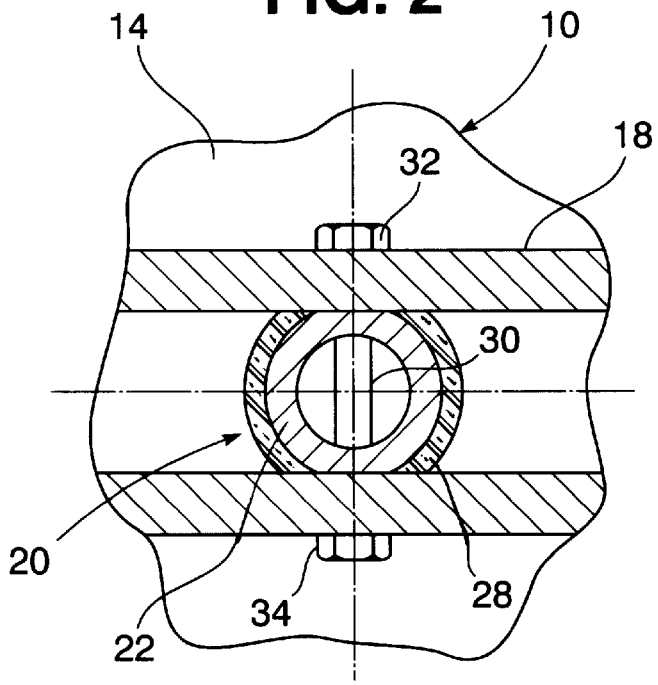
FIG. 2 is a partial section view taken substantially through a plane indicated by section line 2—2 in FIG. 1.

Referring now to the drawing in detail, FIGS. 1 and 2 illustrate a typical installation of the present invention in accordance with one embodiment, involving the attachment of equipment to a bulkhead generally referred to by reference numeral 10. Such bulkhead 10 is a sandwich core composite type of construction associated for example with a marine vessel, having inner and outer rigid face skins 12 and 14 made of a fiber reinforced mixture of E-glass fabric and vinyl ester resin for example, spaced apart by a non-metallic low density core 16 of generally known composition such as balsa wood or foam.

FIGS. 1 and 2 show the bulkhead 10 with an elongated load transfer channel 18, made of steel for example, attached thereto on one side of the bulkhead in close spaced relation to its rigid face skin 14 by an attachment fastener assembly 20. The channel 18 thereby transfers loading to the bulkhead 10 from equipment (not shown) suitably attached to the channel 18 in spaced relation to the attachment fastener assembly 20 interconnecting the channel 18 with the bulkhead 10.

In the embodiment illustrated in FIGS. 1 and 2, the attachment assembly 20 includes a rigid insert 22 which is plugged into a cylindrical pocket extending between a cylindrical opening 24 in the rigid face skin 14 and a cylindrical recess 26 axially aligned therewith in the internal face of the rigid face skin 12. The insert 22 is externally covered by a paste adhesive 28 within the pocket for adhesive bonding to the bulkhead by contact with the interface surfaces of the pocket in the skins 12 and 14 and in the core 16. The channel 18 is held attached to the insert 22 by a fastener bolt 30 having a head portion 32 at one end held in external abutment with the upper flange of the channel 18 by a nut 34 in threaded engagement with the bolt at its lower end in abutment with the lower flange of the channel 18.

The attachment assembly 20 as hereinbefore described together with the pocket formed in the bulkhead 10 provides simple and novel means for creating an anchoring location in the bulkhead 10 having a low density core 16 which is ordinarily designed to carry shear loads between the skins 12 and 14 rather than bending loads. Such bending load supporting capability of the attachment assembly 20 obviates the need for undesirable through-bolt penetration of the sandwich core bulkhead or modifications thereof other than the formation therein of pockets for reception of plug-in inserts 22 through which static and dynamic loads are more broadly distributed.

Figure 3:
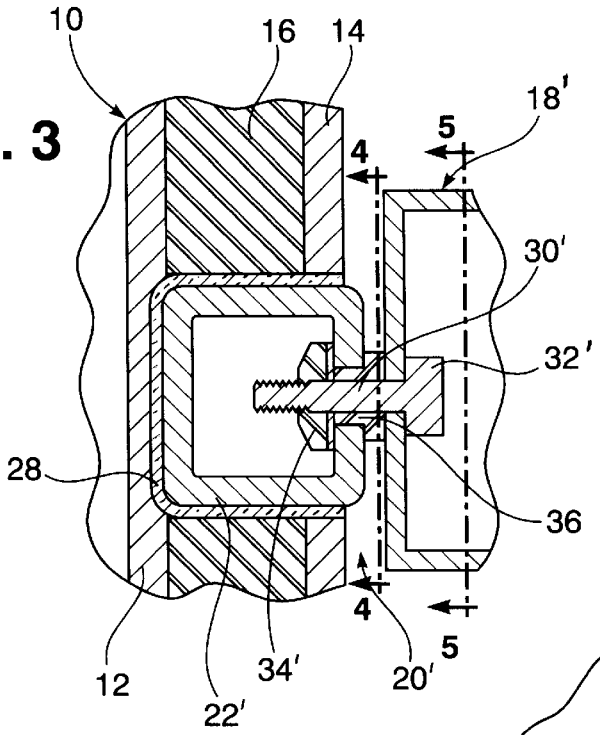
FIG. 3 is a partial side section view of an attachment to the bulkhead, in accordance with second embodiment of the present invention.
Figure 4:
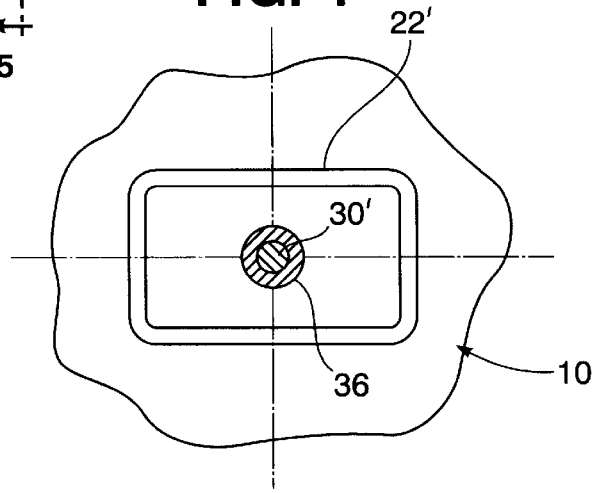
FIGS. 4 and 5 are partial section views taken substantially through planes indicated by section lines 4—4 and 5—5 in FIG. 3.
Figure 5:
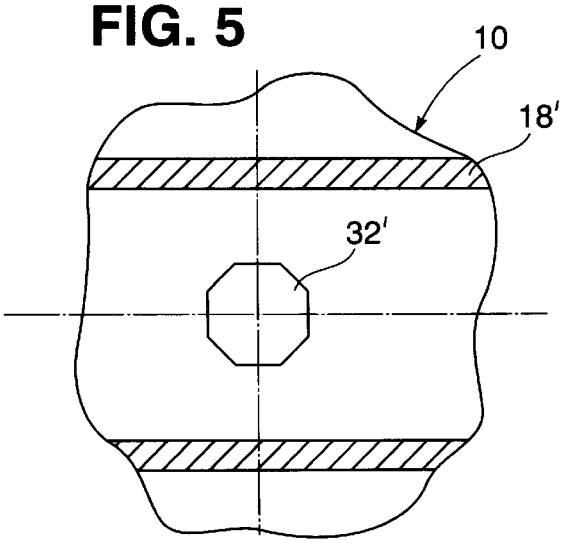

FIGS. 3, 4 and 5 illustrate another embodiment involving a load attachment 20' for the same type of bulkhead 10 having inner and outer rigid skins 12 and 14 and low density core 16 within which a pocket extends having a rectangular rather than a circular cross-sectional configuration. Thus, such rectangular pocket is coated by the paste adhesive 28 for adhesive bonding of the bulkhead to a rigid insert 22' as shown in FIG. 3. Such insert 22' is rectangular, box-shaped to which heavy equipment is attached by a load transfer element 18' and at least one fastener assembly 20' having a fastener bolt 30' which extends into the pocket. The bolt 30' has a head portion 32' at one end held in abutment with the load transfer element 18' by a nut 34' threadedly mounted on the bolt 30' within the insert 22' inside of the pocket. The bolt 30' extends from the element 18' into the box-shape insert 22' through a spacer sleeve 36 clamped between the element 18' and the insert 22' as shown in FIG. 3, to sealingly separate the insert 22' from contact with the bolt 30' and the element 18'.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a bulkhead having a relatively low density core sandwiched between spaced rigid skins, attachment means for connecting equipment to said bulkhead imposing bending and shear loads thereon, comprising: a load transfer element to which said equipment is attached externally of the bulkhead; a pocket formed in the bulkhead in spaced relation to said equipment; a rigid plug-in insert extending into the pocket through one of the rigid skins of the bulkhead; adhesive means for bonding the insert to the bulkhead within said pocket; and mechanical fastener means extending from the load transfer element into the insert for removable connection thereof to the bulkhead.

2. The combination as defined in claim 1, wherein said pocket extends from an opening formed in said one of the rigid skins of the bulkhead through the low density core into a recess formed in the other of the rigid skins in axial alignment with said opening.

3. The combination as defined in claim 2, wherein said insert is cross-sectionally cylindrical and is clamped to the load transfer element externally of the bulkhead by the mechanical fastener means in close spaced relation said one of the skins of the bulkhead.

4. The combination as defined in claim 3, wherein the load transfer element is channel-shaped in cross-section.

5. The combination as defined in claim 2, wherein the load transfer element is channel-shaped in cross-section.

6. The combination as defined in claim 1, wherein said insert is of a rectangular, box-shaped configuration clamped to the load transfer element by the mechanical fastener means extending into the pocket.

7. The combination as defined in claim 6, wherein said pocket extends from an opening formed in said one of the rigid skins of the bulkhead through the soft core into a recess formed in the other of the rigid skins in axial alignment with said opening.

* * * * *